United States Patent [19]

Kwako

[11] 4,006,531

[45] Feb. 8, 1977

[54] GUN SIGHT

[76] Inventor: Stanley J. Kwako, Heaton, N. Dak. 58450

[22] Filed: Sept. 15, 1975

[21] Appl. No.: 613,355

[52] U.S. Cl. ..... 33/261

[51] Int. Cl.[2] ..... F41G 1/02; F41G 1/52

[58] Field of Search ..... 33/261

[56] References Cited

UNITED STATES PATENTS

| | | | |
|---|---|---|---|
| 1,226,952 | 5/1917 | Dyer | 33/261 |
| 1,596,896 | 8/1926 | Segee | 33/261 |
| 2,056,469 | 10/1936 | King | 33/261 |
| 3,133,353 | 5/1964 | Williams | 33/261 |

*Primary Examiner*—Steven L. Stephan
*Attorney, Agent, or Firm*—M. Ted Raptes

[57] ABSTRACT

An auxiliary gun sight adapted to be fitted and used around either one barrel or double barrel guns as well as the gun stock. The auxiliary gun sight comprises a cylindrical elastomeric member having three adjacent projecting sights at angles to each other on its outer periphery. The projecting sights are used to provide a lead in sighting and aiming a gun at a moving target. Several modifications are disclosed.

2 Claims, 10 Drawing Figures

GUN SIGHT

BACKGROUND OF THE INVENTION

This invention relates to gun sights and more particularly to auxiliary, lead gun sights. The normal gun sight on a gun provides for accurately pointing the gun in the exact direction of the target. With moving targets such as birds, etc., it is necessary for a marksman or hunter to develop a great deal of skill in sighting the target with the gun sight as it moves and to accurately shoot at the target as it moves. In accordance with this invention, an auxiliary gun sight is provided for aiding in the shooting at moving targets.

SUMMARY OF THE INVENTION

It is an object of this invention to provide an auxiliary novel gun sight adapted to be removably secured around barrels and stocks of guns.

Another object of this invention is to provide a novel auxiliary gun sight having a plurality of sights.

A further object of this invention is to provide a novel auxiliary gun sight which improves accuracy in the shooting of moving targets.

An additional object of this invention is to provide a novel auxiliary gun sight, which is simple in construction, economical to manufacture, and adaptable to any type of gun.

Generally, the novel gun sight comprises a ring type elastic member having three adjacent sighting means on the outer periphery. The gun sight is easily mounted around the barrel or barrels and stock of the gun at a suitable distance from the breech of the gun. Various modifications of the gun sight are also disclosed.

Other features and advantages of the invention will become apparent from the following description of a specific embodiment and modifications of the gun sight taken in conjunction with the drawings.

DETAILED DESCRIPTION OF THE INVENTION

Figure 1:
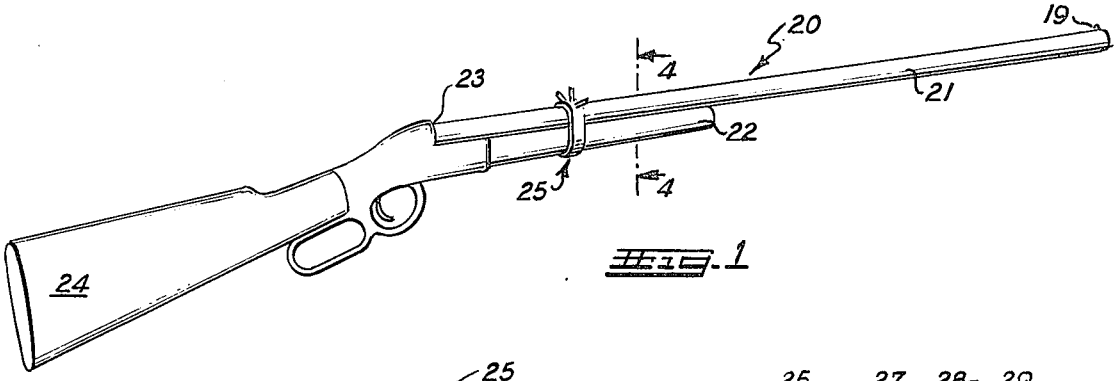
FIG. 1 is a side perspective view of a gun illustrating the novel auxiliary gun sight of the invention thereon.
Figure 2:
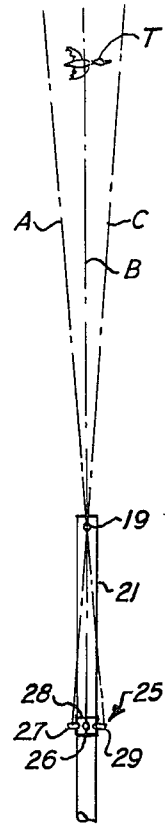
FIG. 2 is a diagrammatic view showing the use of the gun sight.
Figure 3:
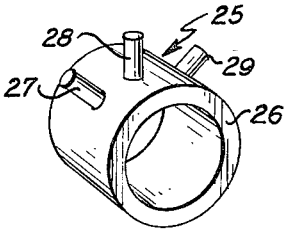
FIG. 3 is a perspective view of the gun sight of the invention.
Figure 4:
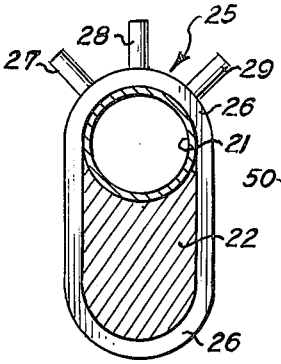
FIG. 4 is a sectional view taken along line 4—4 of FIG. 1.

Referring to FIGS. 1, 2 and 4, the numeral 20 generally refers to a single barrel gun comprising a conventional gun sight 19, a barrel 21, barrel stock 22, breech 23 and butt stock 24. The auxiliary gun sight of the invention is generally denoted by the numeral 25 and is shown mounted in FIG. 1 around the barrel 21 and barrel stock 22.

The auxiliary gun sight can be integrally constructed as by molding from a plastic or rubber material having elastic properties. It comprises a cylindrical portion 26 and three sights 27, 28 and 29 disposed on the outer periphery of the portion 26. The sights are adjacent to each other and when mounted on the gun the center sight 28 is disposed perpendicularly and sights 27 and 29 are disposed at an angle to and on each side of sight 28.

In FIG. 4, the gun sight 25 is shown mounted on gun 20. The cylindrical portion 26 is distended and fitted around the gun barrel 21 and gun stock 22. The sights are adjusted so as to dispose them along the top of the barrel of the gun with sight 28 being disposed perpendicularly. The elastic property of the cylindrical portion 26 retains the gun sight snugly and securely on the gun 20.

The auxiliary gun sight 25 is positioned forward of the breech 23 at a distance determined by the type of target encountered and the experience of the person shooting the gun. With game birds in flight, for example, the determinantes can comprise distance, speed, and course of the birds. Game birds can travel anywhere from about 25–30 miles per hour up to about 70 miles per hour and more. Thus, it requires great skill on the part of a hunter using the conventional gun sight 19 to shoot flying game. The auxiliary gun sight of the invention provides a lead angle in sighting a target. As shown in FIG. 2, a game bird T can be sighted on sight 29 along line of sight A, the trigger pulled and chances are good, depending on the skill of the hunter, that the bird will be along the line of sight B (parallel to the barrel 21) when the gun shell or gun shot reaches the target. Similarly, sight 27 is used when the direction of travel of the target is in the opposite direction. The lead provided by the angle formed by lines of sight A and B, and also B and C, is very advantageous to the less experienced hunter.

The distance of the gun sight 25 from breech 23 is therefore determined by many factors including the experience of the hunter as well as the target. Experimentation with various distances will reveal to the hunter the optimum distance for the particular target involved. For example, it has been determined that for duck hunting the target distance is usually about 20 to 60 yards and if the target is moving at 70 feet per second and a shot gun is used with No. 4 shot and a muzzle velocity of 1330 feet per second, then at 60 yards the lead required is about 14 feet, at 40 yards, the lead required is about 8 feet; and at 20 yards, the lead required is about 4 feet. It was determined, for example, that with the 40 yard distance, the distance the gun sight should be positioned in front of the breech should be about 10–12 inches.

The sights 27, 28 and 29 are integral with cylindrical portion 26 and are generally about ⅛ to ¼ inch long. The length of the sights determines the aiming of the gun. With shorter sights, the aiming will be lower and with longer sights, the aiming will be higher. The line of sight is along the tops of the sights.

Figure 5:
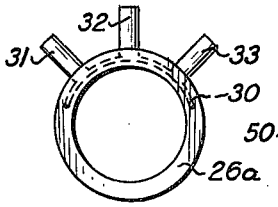
FIG. 5 is a first modification of the gun sight of the invention.
Figure 6:
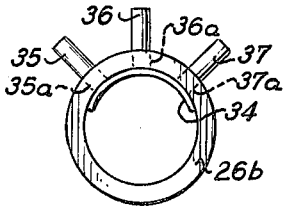
FIG. 6 is a second modification of the gun sight of the invention.
Figure 7:
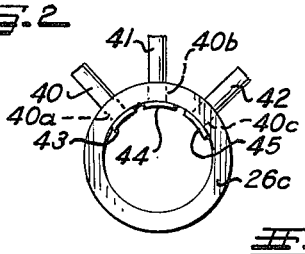
FIG. 7 is a third modification of the gun sight of the invention.

In FIGS. 5, 6 and 7, modifications of the auxiliary gun sight are shown. In FIG. 5, the modification comprises the cylindrical portion 26*a* constructed of an elastomeric material and a rigid arcuate member 30 containing the sights 31, 32 and 33. Member 30 and sights 31, 32 and 33 are formed integrally as a rigid unit from a plastic metal. The rigid sight unit is contained within the cylindrical portion 26*a* during molding thereof.

In FIG. 6, the modification comprises the elastomeric cylindrical portion 26*b* comprising holes 35*a*, 36*a*, and 37*a*. A rigid sight unit comprising arcuate member 34 and sights 35, 36 and 37 can be inserted in the respective holes of the cylindrical portion 26*b*. With this embodiment, various lengths of sights 35, 36 and 37 can be replaceable in the cylindrical portion 26*b*.

In FIG. 7, the modification comprises the elastomeric cylindrical portion 26*c* having holes 40*a*, 40*b*, and 40*c*. Individual sight members 40, 41 and 42 can be inserted in the respective holes of the cylindrical portion 26*c*. The sights 40, 41 and 42 have respective stops 43, 44 and 45 to retain the sights in the cylindrical portion 26*c*.

Figure 9:
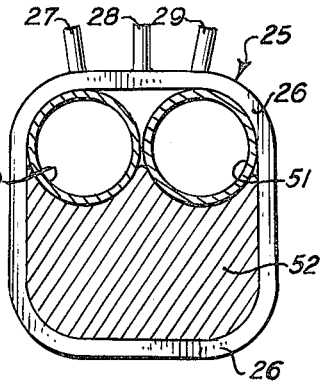
FIG. 9 is a sectional view similar to FIG. 4 showing the gun sight of FIG. 3 on a horizontal type double barrel gun.
Figure 8:
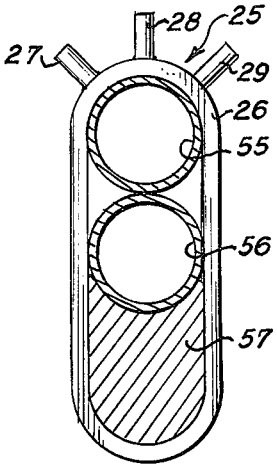
FIG. 8 is a sectional view similar to FIG. 4 showing the gun sight of FIG. 3 on a vertical type double barrel gun.

In FIG. 8, the auxiliary gun sight 25 is shown in use with a vertical type double barrel gun having barrels 55 and 56, and gun stock 57. The elastomeric cylindrical portion 26 can be distended to be positioned around both barrels as well as the gun stock. The modification can also be used with the double barrel gun shown in FIG. 8. In addition, the gun sight 25 can also be used as shown in FIG. 9 with a horizontal type-double barrel gun having barrels 50 and 51 and gun stock 52. In the use with horizontal type double barrels, the angles between the sights become less as the gun sight is placed over the barrels and the stock. However, adjustment of the gun sight on the gun to an optimum sighting position is easily accomplished. The modification of FIG. 7 is also applicable as gun sight 25 to horizontal type double barrel guns.

Figure 10:
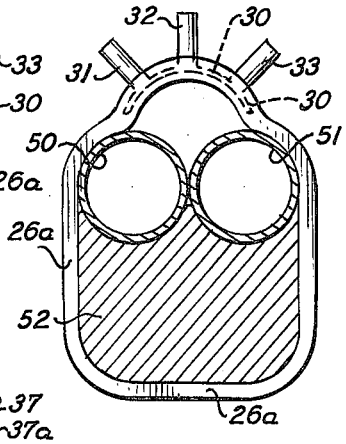
FIG. 10 is a sectional view similar to FIG. 9 showing the modified gun sight of FIG. 5 on a horizontal type double barrel gun.

In FIG. 10, the use of the modification of FIGS. 5 and 6 is shown with respect to horizontal-type double barrel guns. The rigid sight member 30 raises the sights 31, 32 and 33 to some degree above the barrels. However, the respective angles of the sights is maintained. Adjustment with respect to the raised sights is easily accomplished by moving the auxiliary gun sight along the barrels.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An auxiliary lead-type gun sight adaptable for use universally with shotguns and rifles of the single-barrelled type and of the double-barrelled type disposed either vertically or horizontally, comprising a unitary, elastic cylindrical member adapted to be mounted around one barrel or two barrels and stock of guns and rifles at a suitable distance from the breech thereof, three adjacent upwardly projecting gun sights disposed and aligned circumferentially on the outer periphery of said cylindrical member, said gun sights when mounted on said barrel or barrels adapted to have the center sight project vertically at the midpoint between said barrel or barrels and the two side sights adapted to project at an outward upward angle with respect to said center sight, said cylindrical member and gun sights being integrally molded from an elastomeric material capable of being distended sufficiently to fit around each of the various configurations of said shotguns and rifles.

2. The auxiliary gun sight of claim 1 wherein said projecting gun sights are integral with a rigid arcuate member embedded within said cylindrical member.

* * * * *